United States Patent [19]

Islas

[11] 4,287,867

[45] Sep. 8, 1981

[54] COMPOUND BOW

[75] Inventor: John J. Islas, Canastota, N.Y.

[73] Assignee: Victor United, Inc., Chicago, Ill.

[21] Appl. No.: 124,473

[22] Filed: Feb. 25, 1980

[51] Int. Cl.[3] ..... F41B 5/00

[52] U.S. Cl. ..... 124/24 R; 124/DIG. 1

[58] Field of Search ..... 124/24 R, 23 R, 41 A, 124/88, 86

[56] References Cited

U.S. PATENT DOCUMENTS

| | | | |
|---|---|---|---|
| 3,674,001 | 7/1972 | Hitt | 124/24 R |
| 3,744,473 | 7/1973 | Nishioka | 124/24 R |
| 3,923,035 | 12/1975 | Trotter | 124/86 X |
| 3,981,290 | 9/1976 | Islas | 124/24 R |
| 4,207,859 | 6/1980 | Scholten | 124/24 R |

*Primary Examiner*—Richard C. Pinkham
*Assistant Examiner*—William R. Browne
*Attorney, Agent, or Firm*—Bruns & Jenney

[57] ABSTRACT

An archery bow having a riser capable of being gripped by an archer from which is centilevered upper and lower spring members. Bow limbs are pivotably suspended from the free end of each spring member at the midsection thereof so that each limb hangs on the archer's side of the bow. A bow string is attached to upwardly extended tips of the limbs. Cams, which are rotatably supported from the top and bottom sections of the riser, are connected to the lower portion of each limb by means of a control cable that is reeved to the working profile of the cam. One end of the control cable is secured to the base of the associated limb while the opposite end is secured to the limb's midsection to hold the control cable taut against the working surface of the associated cam. Accordingly, as the bow is drawn, the pull weight delivered to the bow string is controlled by the cam system to provide maximum pull weight at an intermediate draw position.

10 Claims, 5 Drawing Figures

COMPOUND BOW

BACKGROUND OF THE INVENTION

This invention relates to an improved compound bow of the type utilizing coacting spring member and bow limbs and, in particular, to an improved compound bow having programing means for regulating the pull weight of the instrument whereby maximum pull weight is attainable at an intermediate draw position.

Allen in U.S. Pat. No. 3,486,495 discloses a compound bow having a draw control mechanism associated therewith for regulating the pull weight over the draw length of the bow. The mechanism involves a pair of cams that are suspended from the tips of the bow limbs and about which the bow string is trained. In operation, the cams act between the bow limbs and the bow string to control the relative motion therebetween as the string is drawn. The cams are contoured to vary the pull weight of the bow so that maximum pull is reached at an intermediate draw position. As the bow string continues to move back from the intermediate position, the pull weight drops off so that the archer is not required to sustain the bow at maximum pull weight while he is aiming. This leads to greater accuracy as well as a smoother arrow release. Allen also points out that the use of a variable pull weight increases the release energy of the bow when compared to a similar bow which releases at maximum draw.

Hofmeister in U.S. Pat. No. 3,854,467 and Trotter in U.S. Pat. No. 3,923,035 describe variations of the Allen type bow wherein the camming device is suspended from the bow riser rather than the limb tips. In both designs, however, a pulley is mounted in the limb tip and the bow string is trained over the pulley and then brought around the cam to impart the desired motion to the string. An extremely complex and exposed bow string network is thus created which has a number of crossover runs. The crisscrossing bow line makes handling of the device difficult. The exposed, closely positioned runs can also become easily entangled or snared in foreign objects thereby limiting the bow's usefulness, particularly in rough terrain. More importantly, hanging heavy pulleys and cams on the outer extremities of the limbs creates unwanted, and generally unpredictable, inertial forces in the bow system that adversely affect the performance characteristics of the bow.

Islas in U.S. Pat. No. 3,981,290 discloses a compound bow that preserves all the advantages of the Allen type bow while at the same time avoiding the disadvantages associated therewith. Primarily, the Islas design eliminates the need for pulleys and cams to be hung upon the limb tips and provides for a cleaner bow configuration. In the Islas bow, a pair of elongated spring members are extended outwardly from the top and bottom sections of the bow riser. The spring member act in concert with companion bow limbs to deliver the desired pull weight. In assembly, the base of each limb is adapted to ride along the working surface of a stationary cam affixed to the riser. The midsection of the limb is pivotably mounted in the free end of the adjacent spring member and the bow string is simply and cleanly connected to the tips of the limbs. As the string is drawn, the limb is caused to ride along the profiled cam surface thereby imparting a pre-programed response to the bow over the length of the draw.

Although the Islas bow has demonstrated itself to be a highly effective instrument, adjusting and maintaining the stationary cams in alignment with the movable bow limbs sometimes proves difficult. Also, in the Islas bow, the bow limbs are arranged to be pulled back against the resisting spring members which may on occasion create nonsymmetrical friction forces acting on the limbs which can adversely affect the performance of the bow.

SUMMARY OF THE INVENTION

It is therefore an object of the present invention to improve the construction of compound bows.

It is a further object of the present invention to improve compound bows of the type wherein a pair of bow limbs are arranged to act in concert with a pair of elongated spring members cantilevered from top and bottom surfaces of a bow riser.

Another object of the present invention is to simplify the construction of compound bows.

Yet another object of the present invention is to provide a compound bow of the type employing cam means for controlling the motion of a bow limb that is pivotably mounted upon a spring-like power limb.

A still further object of the present invention is to provide a compound bow having a simple rotating cam system that is arranged to control the limbs of the bow to deliver a programed pull to the bow string whereby the draw weight of the bow is varied at a non-linear rate over the length of the draw.

These and other objects of the invention are attained by means of a compound bow having a riser, a pair of outwardly extended spring members cantilevered from the top and bottom sections of the riser, upper and lower limbs pivotably supported at the free ends of each spring member, rotatable cam means pivotably supported in the riser, a flexible cable reeved to the cam and secured at one end to the base of the limb and at the other end to the midsection thereof, and a bow string connected between the tips of the limbs so that drawing of the string causes the cams to rotate, imparting a programed pull to the bow string.

BRIEF DESCRIPTION OF THE INVENTION

For a better understanding of these and other objects of the present invention reference is had to the following detailed description of the present invention which is to be read in conjunction with the accompanying drawing, wherein.

DESCRIPTION OF THE INVENTION

Figure 1:
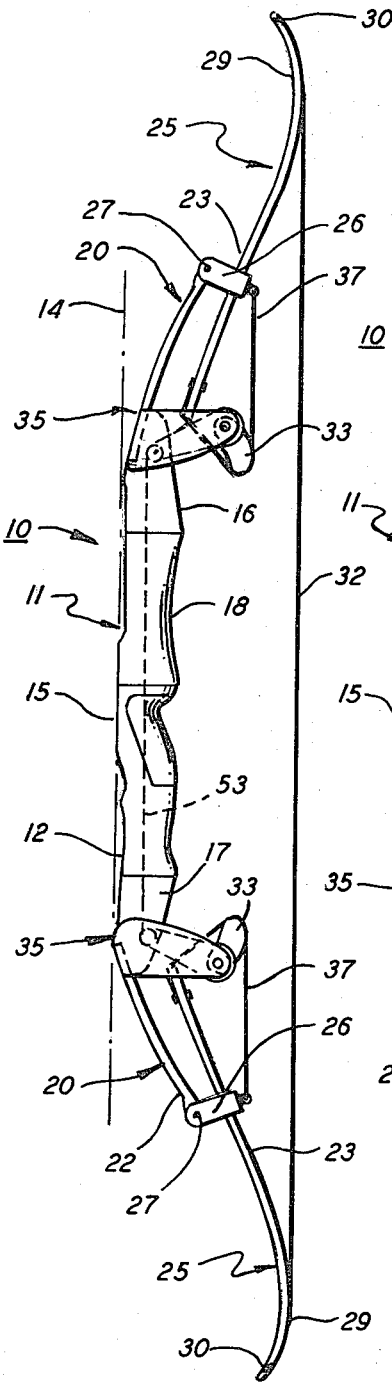
FIG. 1 is a side elevation of a bow embodying the teachings of the present invention showing the bow string at a rest position.
Figure 2:
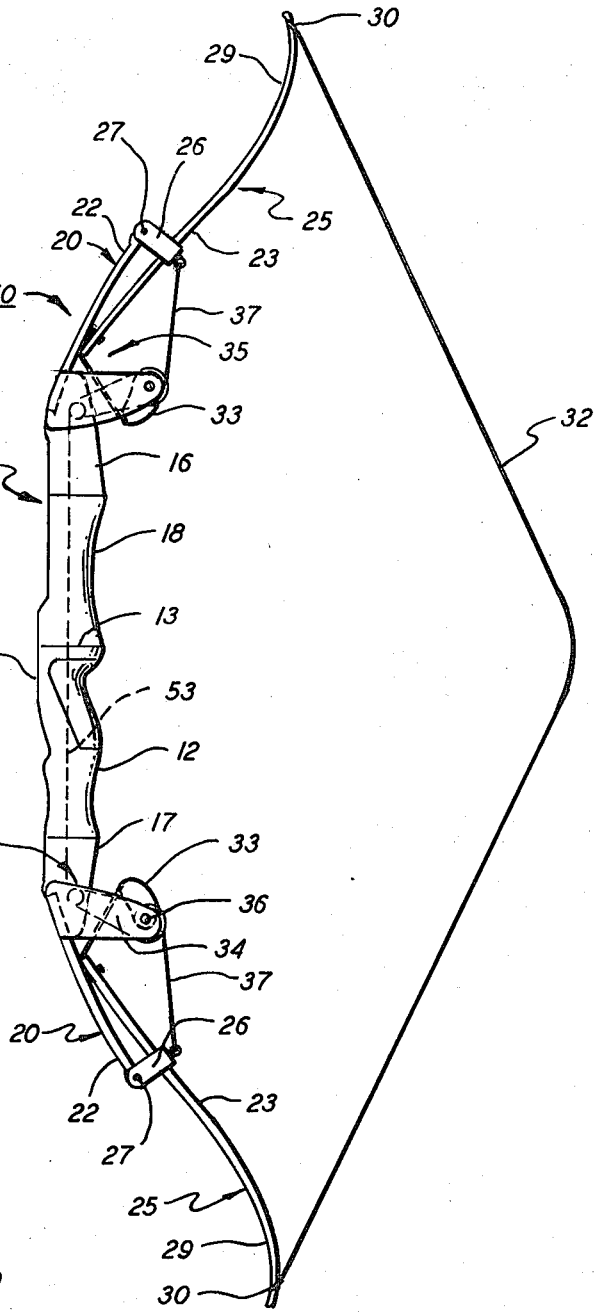
FIG. 2 is also a side elevation of the bow illustrated in Fig. 1 showing the bow string brought to a fully drawn position.

An archery bow that embodies the teachings of the present invention is designated generally 10 in Figs. 1 and 2. The bow includes a central section 11, generally referred to as a riser, having a hand grip 12 formed therein and a flat rest 13 for receiving an arrow therein. For explanatory purposes the present bow will be described as if it were disposed in a normal firing position. Accordingly, the plane 14, describing the front face 15 of the riser, will be vertically positioned while the arrow rest 13 will be horizontally aligned. The riser includes a top end section 16, a bottom end section 17 and a belly 18 that face the archer when he is holding the bow in a firing position.

Figure 3:
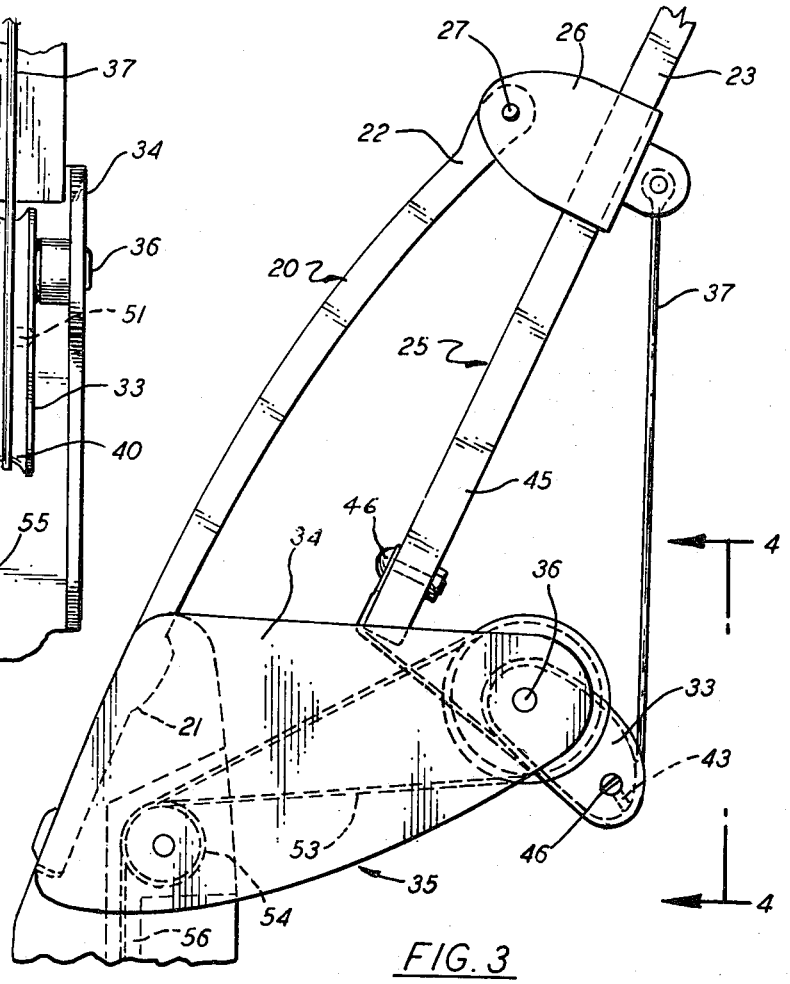
FIG. 3 is an enlarged partial side elevation more clearly illustrating the cam mechanism for controlling the pull response of the bow.

A pair of identical spring members 20—20 (which are sometimes referred to as power limbs) are cantilevered from the top and bottom end sections of the riser as shown in FIGS. 1 and 2. The base of each spring member is securely affixed by any suitable means (not shown) to the front face of the riser within a complimentary mounting socket 21 formed therein (Fig. 3). In assembly, each limb extends outwardly and inwardly so that it normally leans toward the belly side of the riser.

As set out in the previously noted Islas patent, the spring member may be fabricated from any suitable spring-like material in either a single layer or multiple layer structure. Similarly, adjusting means may also be operatively associated with each member to permit the spring response thereof to be varied.

The free end 22—22 of each spring member is pivotably secured to the midsection 23—23 of a companion bow limb 25—25 by means of a clevis 26—26. The base of the clevis is pinned or screwed to the bow limb while the two arms thereof encompass the spring member. The spring member is pivotably mounted between the arms by means of a clevis pin 27—27. Each bow limb 25—25 is a curved element that contains a tip 29—29 at its distal end in which a string notch 30—30 is formed for operatively receiving one end of the bow string 32. As in the case of the spring member, the bow limb is constructed of any suitable material known and used in the art. It should be noted at this point that the bow limbs are suspended from the back or belly side of the spring members. As will become apparent from the disclosure below, as the bow string is drawn, the bow limbs, acting through the clevis, will pull the cantilevered spring members rearwardly with a minimum amount of friction between the coacting members.

Figure 4:
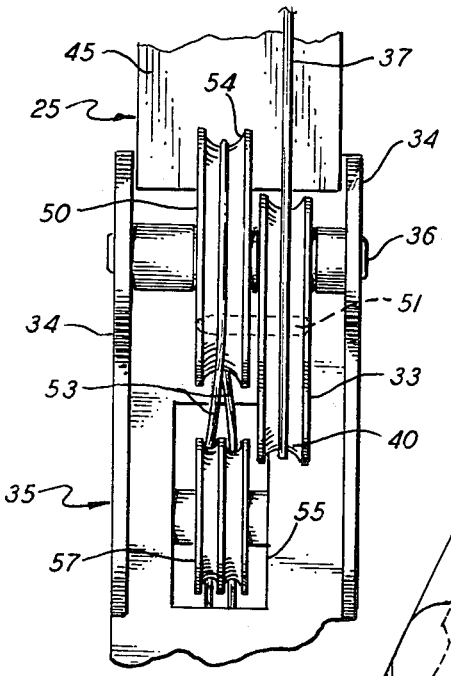
FIG. 4 is an end view taken along lines 4—4 in Fig. 3 further illustrating the cam mechanism and the limb synchronization system used in the present bow.

The proximal end of each bow limb, that is, the end adjacent to the riser, is situated in close proximity with a cam 33—33. The cams are rotatably supported on the belly side of the riser between the horizontally extended arms 34—34 of bifurcated brackets 35—35 upon pivots 36—36. As best seen in FIG. 3, each cam is connected to the adjacent limb by means of a control cable 37—37, or any other suitable flexible connector. In the present embodiment of the invention the cable is secured to the cam by looping it into a radially extended groove 40 and locking the cable in place by means of a set screw 41. The body of the control cable is retained in a peripheral groove 43 (Fig. 4) formed in the cam and is trained over the working profile thereof.

One end of the control cable is secured to the base 45 of the adjacent limb using a screw 46. The opposite end of the cable is secured to the base of the clevis to hold the cable taut against the cam profile so that the cam and the limb move in unison throughout the length of the draw and similarly after release. Although the opposite end of the cable is herein shown affixed to the clevis, it should be apparent that it may be affixed anywhere along the medial section of the limb. As should now be evident to one skilled in the art, drawing the bow string from its rest position towards a fully drawn position causes the cams to rotate about pivots 36. Accordingly, a programed motion is translated by the cam profile to each limb through the control cables which serves to regulate the pull weight of the bow system over the entire length of the draw. It should be further evident that the response of the bow can be easily and effectively changed by altering the working profile of the cam.

Figure 5:
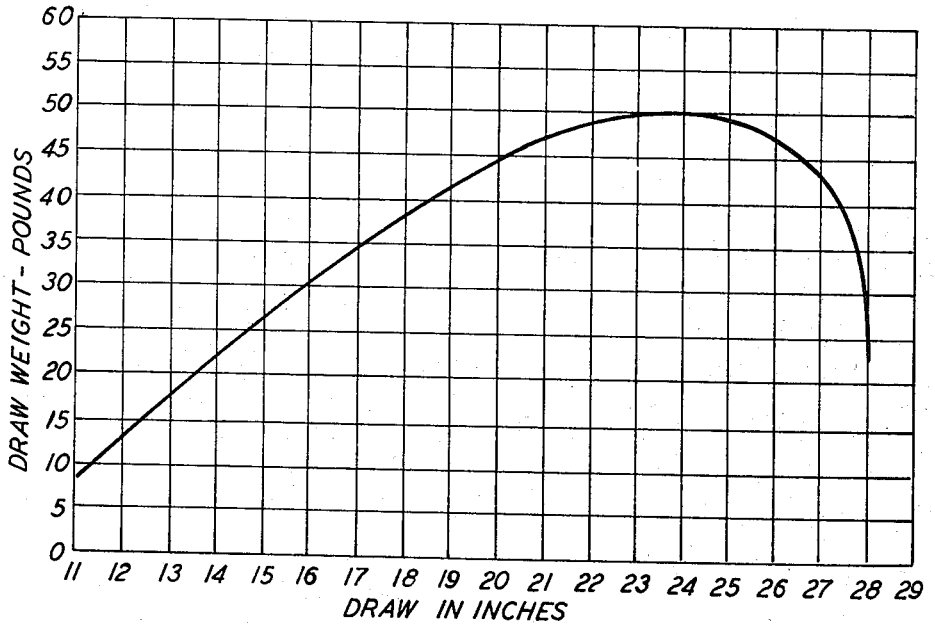
FIG. 5 is a graphical representation showing the relationship between the draw weight and the bow string displacement of the bow depicted in Figs. 1 and 2.

Fig. 5 graphically depicts the draw weight of a compound bow of the present construction relative to the draw displacement of the bow string. For explanatory purposes it will be assumed that the present bow 10 has a draw weight of about 50 pounds, a string brace of approximately 6 inches and a total draw length of about 28 inches. From the diagram it can be seen that the bow pull weight reaches about 9 pounds. At a draw length of about 11 inches the pull continues to increase thereafter at a steady rate. Under the controlled influence of the cam system, the draw weight is permitted to increase to about 50 pounds which occurs at a draw length of about 24 inches. At this time, the lobe of the cam passes its maximum rise position and the control cables begin to release some of the spring loading applied to the limbs despite the fact that the draw length continues to increase. As the length of the draw increases past the 24-inch point, the pull weight decreases rather dramatically until at full draw the pull is about one-half the peak load value.

As can be readily seen, by programing the loading of the bow in the manner herein described, the archer has only to resist about one-half of the maximum pull weight while aiming which, of course, leads to greater accuracy. By the same token, upon release, the energy imparted to the arrow is delivered progressively over an extended period of time which provides for improved flight characteristics of the arrow and greater accuracy when compared to the more conventional long bow that releases at maximum pull weight.

As noted in the previously mentioned Islas patent, to insure constant and repeatable accuracy, the limbs of the bow must act in unison. Synchronization of the limb action is achieved in the present bow by means of a pulley and cable system. The synchronization system includes a pair of main drive sheaves 50—50 that are coaxially aligned with each cam upon the pivot 36. The drive sheave is locked to the adjacent cam by means of a drive pin 51—51, or any other suitable means, so that the two members turn in unison upon the pivot. A flexible connector 53, which is preferably a high strength endless cable, is trained about the drive sheave in the grooves 54—54 provided and, as explained in the previously noted Islas patent, the cable is clamped to the drive sheave to prevent slippage between the sheave and the cable.

The synchronization cable 54 is passed lengthwise through the riser within a longitudinal conduit 56. At the upper and lower entrances 55—55 to the conduit there are rotatably mounted idler pulleys 57—57 that serve to turn the synchronization cable into the conduit. The loop of the endless cable is crossed over in the conduit so that the motion described by one of the drive sheaves is a mirror image of that of the other drive sheave.

As can be seen, the synchronization system is contained substantially within the riser of the bow thereby adding to the aesthetic value of the instrument as well as preventing the component parts thereof from becoming entangled with foreign objects or the like. As should also now be evident, the concept of the present compound bow provides for an extremely smooth and efficient action throughout the extent of its draw. The present bow also provides extremely clean lines when compared to other compound bows known and used in the art and is thus able to be employed both on the target range and in the field. While this invention has been described in reference to the disclosure herein set forth, it is not necessarily limited to this particular embodiment and this application is intended to cover any modifications or changes as may come within the scope of the present invention.

I claim:

1. An archery bow including a riser having a front face arranged to be directed at a target and a belly facing the archer, said riser further having spaced-apart top and bottom ends, a pair of outwardly extended spring members cantilevered from the top and bottom ends of the riser, upper and lower elongated limbs each having a midsection, an outer tip and an inner base, each limb being rotatably connected by pivot means to the free end of one of the extended spring members with the limb being positioned on the belly side of said spring member, a pair of movable cams rotatably supported from the top and bottom ends of the riser adjacent to the base of the upper and lower limbs, cable means trained over each of said cams for movement therewith, each of said cable means being secured at one end to the base of an adjacent limb and at the other end to the midsection of said adjacent limb, and a bow string being connected to the tip of each limb whereby drawing the bow string from its rest position toward a fully drawn position causes the cams to rotate and thus impart a programed motion to said limbs.

2. The archery bow of claim 1 wherein each cam has a contoured working surface acting against the cable trained thereover for applying a maximum force to the bow string at an intermediate position between the rest position and the fully drawn position whereby the string holding force at a fully drawn position is less than at the intermediate position.

3. The archery bow of claim 1 that further includes synchronizing means acting between the cams for coordinating the movement of said limbs.

4. The archery bow of claim 3 wherein said synchronizing means includes pulley means coaxially aligned with each of said cams being secured thereto and a flexible connector reeved to the pulley means so that the pulleys and thus the cams move in unison as the bow string is being drawn.

5. The archery bow of claim 4 that further includes a pair of brackets secured to the top and the bottom of said riser that extend rearwardly toward said bow string, each bracket having a shaft for rotatably supporting a cam and pulley in coaxial alignment thereon.

6. The archery bow of claim 5 wherein said riser contains an opening passing lengthwise therethrough between its top and bottom ends through which said flexible connector passes.

7. The archery bow of claim 1 that further includes a clevis secured at its base to midsection of each limb and wherein the terminal end of the connected spring member is pivotably supported between the extended arms of said clevis by means of a clevis pin.

8. An archery bow including a riser that is adapted to be grasped by an archer having upper and lower spring members cantilevered from the top and bottom surfaces of said riser, upper and lower cams rotatably supported at the top and bottom of the riser, a limb pivotably mounted about its midsection upon the terminal end of each of said spring members, a control cable reeved about each of said cams and being secured at both ends to an adjacent one of said limbs, said ends of the cable being spaced apart along the length of the limb, and a bow string connected between the outer tips of the limbs whereby application of a drawing force upon said bow string causes the cables to rotate the cams thereby imparting a programed motion to said limbs.

9. The archery bow of claim 8 that further includes synchronizing means connected between the cams for coordinating the motion thereof whereby the cams move in unison as said bow string is drawn.

10. The archery bow of claim 8 wherein said control cable is secured at one end to the midsection of one of said limbs and at the other end of the cable is secured to the base of the limb.

* * * * *